US011631928B2

(12) United States Patent
Li et al.

(10) Patent No.: US 11,631,928 B2
(45) Date of Patent: Apr. 18, 2023

(54) PHASE SHIFTER AND MANUFACTURING METHOD THEREOF

(71) Applicant: BOE TECHNOLOGY GROUP CO., LTD., Beijing (CN)

(72) Inventors: Chunxin Li, Beijing (CN); Jingwen Guo, Beijing (CN); Qianhong Wu, Beijing (CN); Kui Liang, Beijing (CN); Tuo Sun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/336,448

(22) Filed: Jun. 2, 2021

(65) Prior Publication Data

US 2022/0131247 A1 Apr. 28, 2022

(30) Foreign Application Priority Data

Oct. 23, 2020 (CN) ..... 202011150296.7

(51) Int. Cl.
*H01P 1/18* (2006.01)
*H01P 11/00* (2006.01)

(52) U.S. Cl.
CPC ..... *H01P 1/182* (2013.01); *H01P 11/00* (2013.01)

(58) Field of Classification Search
CPC ..... H01P 1/182; H01P 11/00
See application file for complete search history.

(56) References Cited

U.S. PATENT DOCUMENTS 5,578,976 A * 11/1996 Yao ..... H01H 59/0009 333/262
8,315,030 B2 * 11/2012 Yamazaki ..... H01G 5/16 361/290
2020/0102213 A1 * 4/2020 Haridas ..... H01P 3/08

FOREIGN PATENT DOCUMENTS

CN 2657214 Y * 11/2004
CN 2657214 Y 11/2004
CN 101694896 A 4/2010
CN 101777461 A 7/2010
EP 1752415 A2 * 2/2007 ..... B81C 1/0015

OTHER PUBLICATIONS

China Patent Office, First Office Action dated Nov. 11, 2022 for application No. CN202011150296.7.

* cited by examiner

*Primary Examiner* — Hafizur Rahman
*Assistant Examiner* — Kimberly E Glenn
(74) *Attorney, Agent, or Firm* — Houtteman Law LLC

(57) ABSTRACT

A phase shifter and a method for manufacturing the same are provided. The phase shifter includes a substrate, a signal line on the substrate, ground lines in pairs and on the substrate, and at least one film bridge on the substrate and spaced apart from the signal line. Two adjacent ground lines of the ground lines are on both sides of the signal line and spaced apart from the signal line, respectively, and both ends of each film bridge are on the two adjacent ground lines, respectively. The signal line is in a space surrounded by each film bridge and the substrate. Each film bridge includes a metal layer opposite to the signal line, the metal layer has a plurality of openings therein, and the plurality of openings penetrate through the metal layer in a thickness direction of the metal layer.

20 Claims, 16 Drawing Sheets

PHASE SHIFTER AND MANUFACTURING METHOD THEREOF

CROSS REFERENCE TO RELATED APPLICATIONS

The present application claims the priority of Chinese patent application No. 202011150296.7, filed on Oct. 23, 2020, the content of which is incorporated herein by reference in its entirety.

TECHNICAL FIELD

The present disclosure relates to the field of electronic technologies, and in particular, to a phase shifter and a method for manufacturing a phase shifter.

BACKGROUND

With the rapid development of information technologies, wireless terminals with high integration, miniaturization, multifunction and low cost are gradually becoming the trend of the communication technologies. A phase shifter is an essential key component in communications and radar applications. Traditional phase shifters mainly include a ferrite phase shifter and a semiconductor phase shifter. The ferrite phase shifter has a larger power capacity and a small insertion loss, but large-scale application of the ferrite phase shifter is limited by factors such as its complex manufacturing process, high manufacturing cost, large volume and the like. The semiconductor phase shifter has a small volume and a high operation speed, but has disadvantages such as a small power capacity, a high power consumption and a highly difficult manufacturing process. Compared with the traditional phase shifters, a micro-electro-mechanical system (MEMS) phase shifter has significant advantages in the aspects of insertion loss, power consumption, volume, cost and the like, and thus has attracted wide attention in the fields of radio communications, microwave technologies, and the like.

SUMMARY

Some embodiments of the present disclosure provide a phase shifter and a method for manufacturing a phase shifter.

A first aspect of the present disclosure provides a phase shifter, which includes:

a substrate;

a signal line on the substrate;

ground lines in pairs and on the substrate; and at least one film bridge on the substrate and spaced apart from the signal line, wherein two adjacent ground lines of the ground lines are on both sides of the signal line and spaced apart from the signal line, respectively, both ends of each film bridge are on the two adjacent ground lines, respectively, the signal line is in a space surrounded by each film bridge and the substrate, each film bridge includes a metal layer opposite to the signal line, the metal layer has a plurality of openings therein, and the plurality of openings penetrate through the metal layer in a thickness direction of the metal layer.

In an embodiment, each film bridge further includes two connection walls on the two adjacent ground lines, respectively, and each connection wall has one end connected to the ground line corresponding to the connection wall and the other end connected to the metal layer.

In an embodiment, each film bridge further includes a flexible strip, both ends of the flexible strip are on the two adjacent ground lines, respectively, the flexible strip and the substrate form the space, and the metal layer is on an outer surface of the flexible strip.

In an embodiment, the metal layer has a grid shape.

In an embodiment, the phase shifter further includes an insulating isolation layer covering both the signal line and the two adjacent ground lines, wherein the metal layer and the two connection walls have a one-piece structure, and the two connection walls are on the insulating isolation layer on the two adjacent ground lines, respectively.

In an embodiment, the phase shifter further includes an insulating isolation layer covering the signal line, wherein the metal layer and the two connection walls have a one-piece structure, and the two connection walls are electrically connected to the two adjacent ground lines, respectively.

In an embodiment, a width of each end of both ends of the metal layer is gradually increased in a direction from a central portion of the metal layer to the connection wall corresponding to the end.

In an embodiment, the phase shifter includes a plurality of film bridge groups, each film bridge group includes at least one film bridge, and all of film bridges in a same film bridge group are electrically connected to each other; and the phase shifter further includes a bias voltage supply circuit for selectively supplying a bias voltage to at least one of the plurality of film bridge groups.

In an embodiment, the signal line includes a first U-shaped portion, a second U-shaped portion, and a first connection portion, the second U-shaped portion is in the first U-shaped portion, an opening of the second U-shaped portion and an opening of the first U-shaped portion are directed to a same direction, and the first connection portion electrically connects ends, which are on a same side, of the first U-shaped portion and the second U-shaped portion to each other;

the two adjacent ground lines include a first ground line and a second ground line;

the first ground line has a U-shape and is between the first U-shaped portion and the second U-shaped portion; and the second ground line includes a third U-shaped portion, a second connection portion, and an extension portion, the third U-shaped portion is outside of the first U-shaped portion, an opening of the third U-shaped portion and the opening of the first U-shaped portion is directed to the same direction, the extension portion is in the opening of the second U-shaped portion, and the second connection portion electricity connects the extension portion to an end of the third U-shaped portion proximal to the first connection portion.

In an embodiment, first ends of the two adjacent ground lines are spaced apart from each other, second ends of the two adjacent ground lines extend around each other in a same spiral direction, and the signal line is bent and between the two adjacent ground lines.

In an embodiment, a surface of the one end of each connection wall proximal to the signal line is aligned with a surface, which is proximal to the signal line, of the ground line corresponding to the connection wall.

In an embodiment, the insulating isolation layer is spaced apart from the metal layer.

In an embodiment, the two connection walls are directly on portions of the insulating isolation layer on the two adjacent ground lines, respectively.

In an embodiment, the phase shifter includes N film bridge groups, and an i-th film bridge group has $2^{(i-1)}$ film bridges, where N is a positive integer greater than 1, and i is a positive integer greater than or equal to 1 and less than or equal to N.

In an embodiment, all of the film bridges in the same film bridge group are electrically connected in parallel to each other.

In an embodiment, the bias voltage supply circuit has a plurality of DC bias voltage output terminals connected in one-to-one correspondence with the plurality of film bridge groups.

In an embodiment, the flexible strip includes an organic insulating material.

A second aspect of the present disclosure provides a method for manufacturing a phase shifter, including:

forming a substrate;

forming a signal line and two ground lines on the substrate, wherein the two ground lines are disposed on both sides of the signal line and are spaced apart from the signal line, respectively; and forming at least one film bridge spaced apart from the signal line, wherein both ends of each film bridge are arranged on the two ground lines, respectively, the signal line is located in a space surrounded by each film bridge and the substrate, each film bridge includes a metal layer arranged opposite to the signal line, and a plurality of openings penetrating through the metal layer in a thickness direction of the metal layer are formed in the metal layer.

A third aspect of the present disclosure provides a method for manufacturing a phase shifter, including:

forming a first substrate;

forming a signal line and two ground lines on the first substrate, wherein the two ground lines are disposed on both sides of the signal line and are spaced apart from the signal line, respectively;

forming a second substrate;

forming at least one film bridge on the second substrate, wherein each film bridge includes a metal layer, a plurality of openings penetrating through the metal layer in a thickness direction of the metal layer are formed in the metal layer, and a width of each of both ends of each film bridge is greater than a width of a central portion of the film bridge in a direction perpendicular to the thickness direction;

aligning the first substrate and the second substrate with each other and assembling the first substrate and the second substrate to form a cell, wherein the both ends of each film bridge are connected in one-to-one correspondence with the two ground lines on the both sides of the signal line, the at least one film bridge is spaced apart from the signal line, and the signal line is located in a space surrounded by the at least one film bridge and the first substrate; and removing the second substrate.

BRIEF DESCRIPTION OF THE DRAWINGS

The accompanying drawings, which are included to provide a further understanding of the present disclosure and constitute a part of this specification, are for the purpose of explaining the present disclosure together with the following exemplary embodiments, but are not intended to limit the present disclosure. In the drawings.

DETAILED DESCRIPTION

Figure 1:
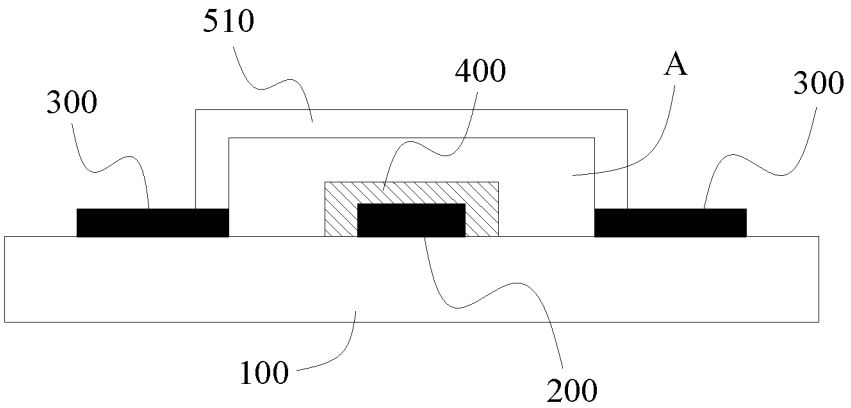
FIG. 1 is a schematic diagram showing a structure of a phase shifter according to an embodiment of the present disclosure.

Exemplary embodiments of the present disclosure will be described in detail below with reference to the accompanying drawings. It should be understood that the exemplary embodiments described herein are only for illustrating and explaining the present disclosure, but are not for limiting the present disclosure.

A MEMS phase shifter generally includes a substrate, a waveguide signal line disposed on the substrate, and two waveguide ground lines disposed on the substrate and on both sides of the waveguide signal line, and the waveguide signal line and the two waveguide ground lines are coplanar (e.g., are in a same plane) to form a coplanar waveguide (CPW) transmission line. The MEMS phase shifter may further include a metal film bridge located above the waveguide signal line and bridge connecting (or bridge jointing or bridging) the two waveguide ground lines located on both sides of the waveguide signal line. A central portion of the metal film bridge is suspended above the waveguide signal line and forms an air gap with the waveguide signal line. The metal film bridge and the waveguide signal line form a switch. Electrostatic adsorption can occur between the central portion of the metal film bridge and the waveguide signal line by providing a bias voltage, such that the metal film bridge is pulled down, and a capacitance between the metal film bridge and the waveguide signal line is changed, thereby changing a phase of a signal (e.g., a radio frequency signal) transmitted on the waveguide signal line.

The inventors of the present inventive concept have found in researches that, a driving voltage of a switch in a conventional MEMS phase shifter is too high, which is mainly caused by the fact that a stress is often remained in the metal film bridge and a Young's modulus of the conventional metal film bridge is generally high, and thus a large elastic force of the metal film bridge often needs to be overcome when the metal film bridge is pulled down by electrostatic adsorption, thereby causing the driving voltage required for switching the switch to be too high. In other words, the driving voltage of the switch in the conventional MEMS phase shifter is high, which increases the difficulty of the MEMS phase shifter in practical applications.

At least to solve the above technical problems, some embodiments of the present disclosure provide a MEMS phase shifter (which may be hereinafter simply referred to as "phase shifter") with a low driving voltage and a method for manufacturing the phase shifter.

As a first aspect of the present disclosure, there is provided a phase shifter, as shown in FIGS. 1, 2, 5, 6, 9 and 10. The phase shifter includes a substrate 100, a signal line 200 disposed on the substrate 100, ground lines 300 disposed in pairs on the substrate 100, and at least one film bridge disposed on the substrate 100. The at least one film bridge is spaced apart from the signal line 200 such that the at least one film bridge can be pulled down (i.e., deformed in a direction toward the signal line 200). Two adjacent ground lines 300 of the ground lines 300 are respectively located on both sides of the signal line 200 and spaced apart from the signal line 200, and both ends of the film bridge are (e.g., directly) disposed on the two adjacent ground lines 300, respectively. The signal line 200 is located in a space A surrounded by the film bridge and the substrate 100, and the space A may be filled with air. The film bridge includes a metal layer 510 disposed opposite to the signal line 200, and a plurality of openings 511 penetrating through the metal layer 510 in a thickness direction (e.g., a vertical direction in FIG. 1, 5, or 9, or a direction perpendicular to a plan view shown in FIG. 2, 6, or 10) of the metal layer 510 are formed in the metal layer 510.

In an embodiment of the present disclosure, the metal layer 510 of the film bridge is formed with the plurality of openings 511 therein, such that the openings 511 can release the residual stress in the film bridge, thereby reducing an elastic force that needs to be overcome when the film bridge is pulled down through the electrostatic adsorption between the film bridge and the signal line 200, reducing a driving voltage required for pulling down the film bridge, and improving a response capability of the phase shifter.

Figure 9:
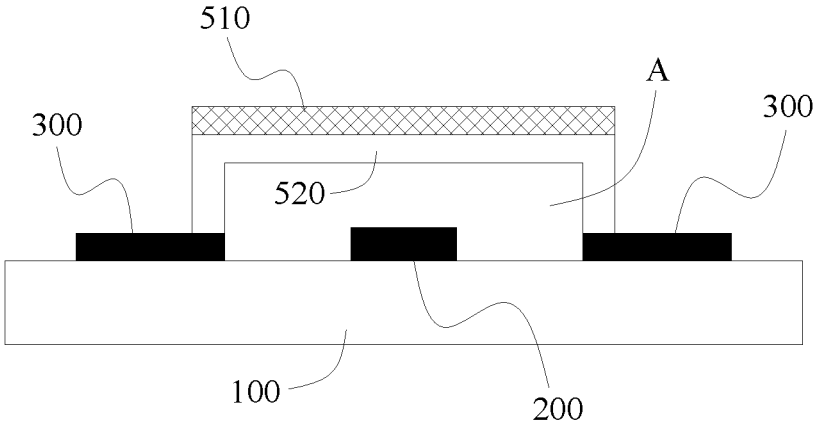
FIG. 9 is a schematic diagram showing a structure of a phase shifter according to another embodiment of the present disclosure.

For example, in a direction (e.g., the vertical direction in FIG. 2, 6 or 10) perpendicular to the thickness direction, a dimension (e.g., a width) of each of the both ends of the film bridge is greater than a dimension (e.g., a width) of a central portion of the film bridge, which can make it easier to pull down the film bridge, thereby further reducing the driving voltage of the phase shifter. Further, in the direction (e.g., the vertical direction in FIG. 2, 6 or 10) perpendicular to the thickness direction, a dimension (e.g., a width) of each of both ends of the metal layer 510 is greater than a dimension (e.g., a width) of a central portion of the metal layer 510, which can make it easier for the metal layer 510 to be pulled down, thereby further reducing the driving voltage of the phase shifter. For example, the metal layer 510 and a flexible strip 520 to be described later may completely overlap each other in the direction perpendicular to the thickness direction, as shown in FIGS. 9 and 10.

Figure 5:
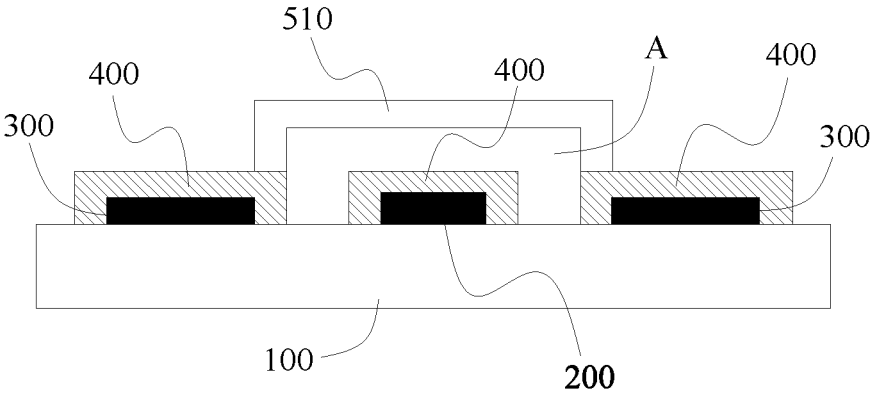
FIG. 5 is a schematic diagram showing a structure of a phase shifter according to another embodiment of the present disclosure.

A specific shape of each of the at least film bridge is not particularly limited in an embodiment of the present disclosure. For example, each of the at least film bridge may optionally further include two connection walls (e.g., two vertical portions of the metal layer 510 shown in FIGS. 1 and 5 or two vertical portions of the flexible strip 520 of the film bridge shown in FIG. 9) and the two connection walls are respectively disposed on the two adjacent ground lines 300, as shown in FIGS. 1, 2, 5, 6, 9 and 10. Each of the connection walls has one end connected to a corresponding ground line 300 (such that a surface of the connection wall proximal to the signal line 200 is aligned or flush with a surface of the corresponding (or connected) ground line 300 proximal to the signal line 200), and has the other end connected to the metal layer 510 as shown in FIG. 9 (or connected to the remaining portion or the central portion of the metal layer 510 as shown in FIGS. 1 and 5). That is, the metal layer 510 as shown in FIG. 9 (or, the remaining portion or the central portion of the metal layer 510 as shown in FIGS. 1 and 5) is connected to the two connection walls, respectively.

Figure 2:
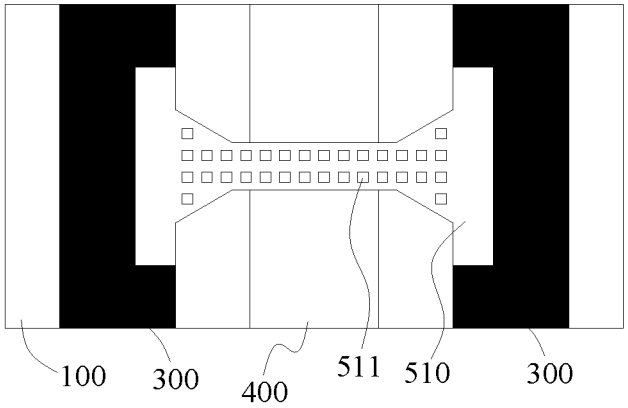
FIG. 2 is a schematic top view of the phase shifter shown in FIG. 1.
Figure 3A:
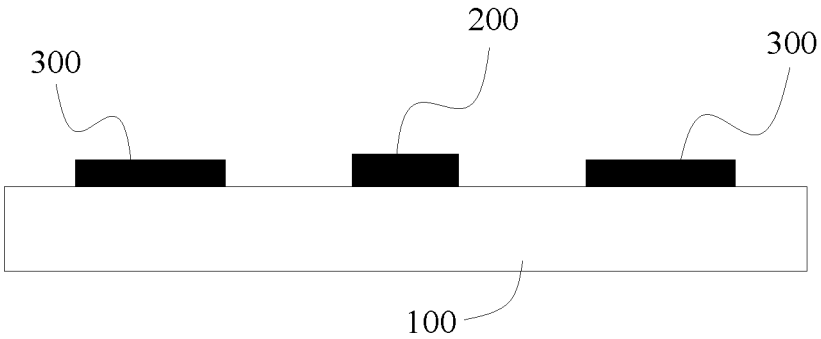
FIGS. 3(*a*) to 3(*e*) are schematic views illustrating a method for manufacturing the phase shifter shown in FIG. 1.
Figure 3B:
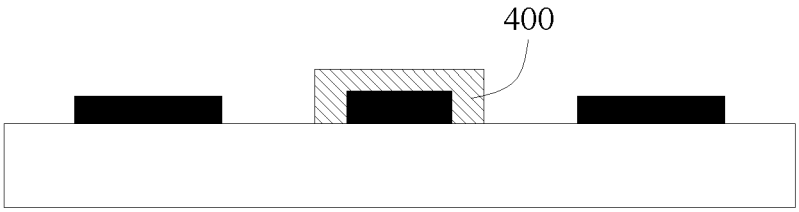
Figure 3C:
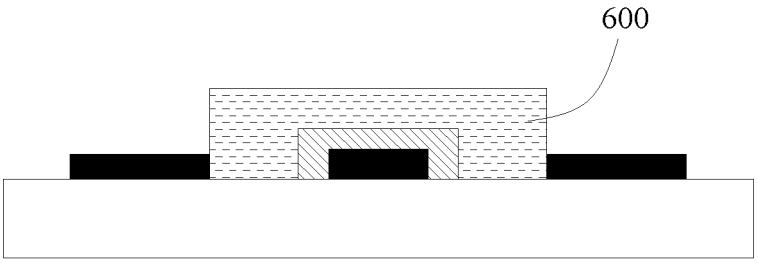
Figure 3D:
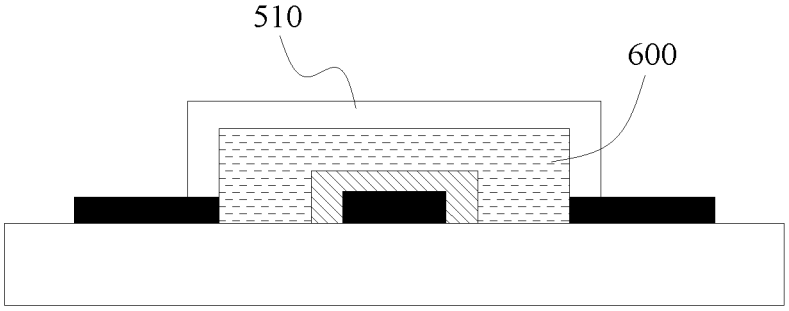
Figure 3E:
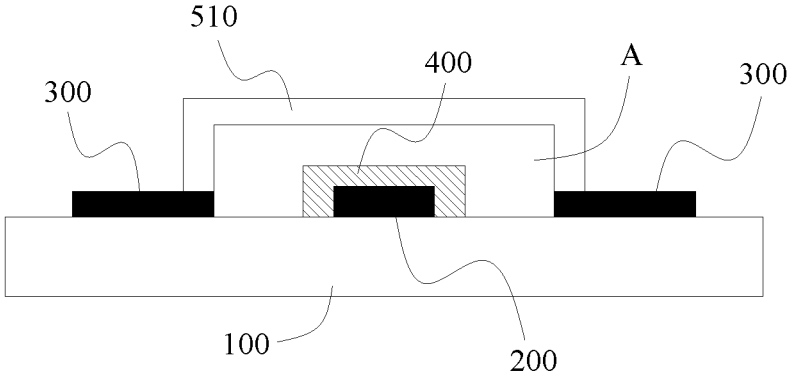
Figure 4A:
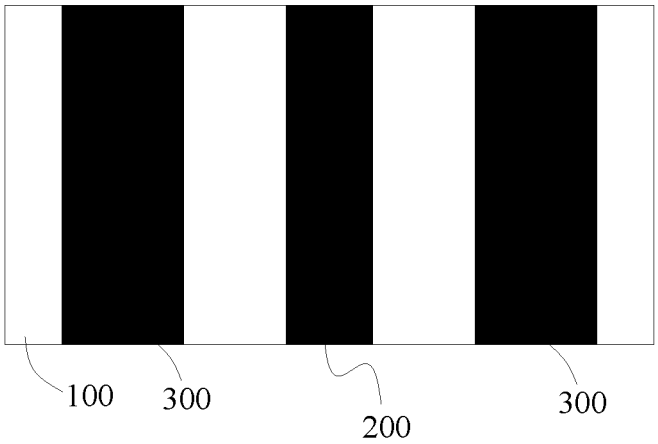
FIGS. 4(*a*) to 4(*e*) are schematic top views corresponding to steps in the manufacturing method shown in FIGS. 3(*a*) to 3(*e*), respectively.
Figure 4B:
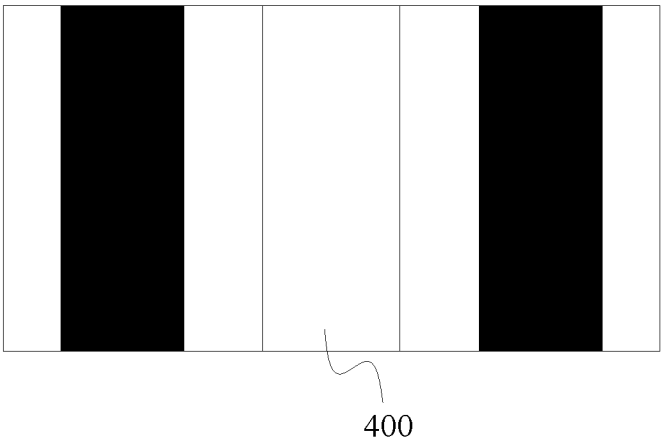
Figure 4C:
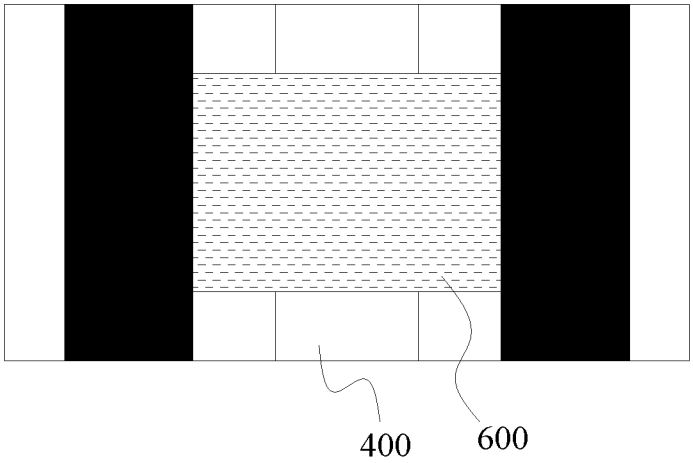
Figure 4D:
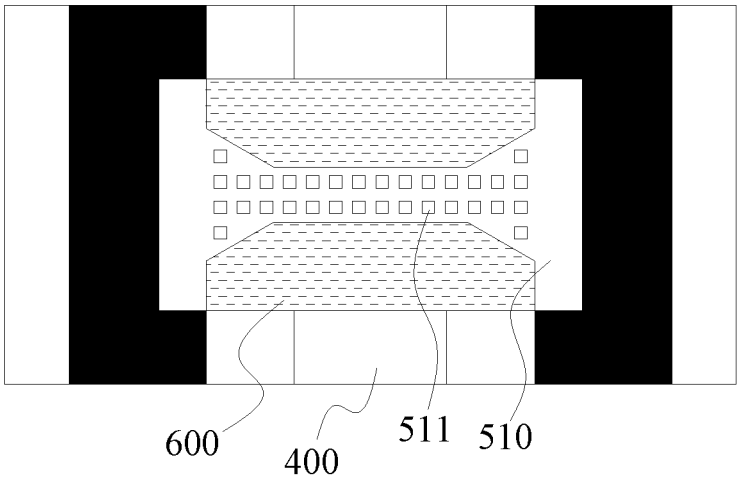
Figure 4E:
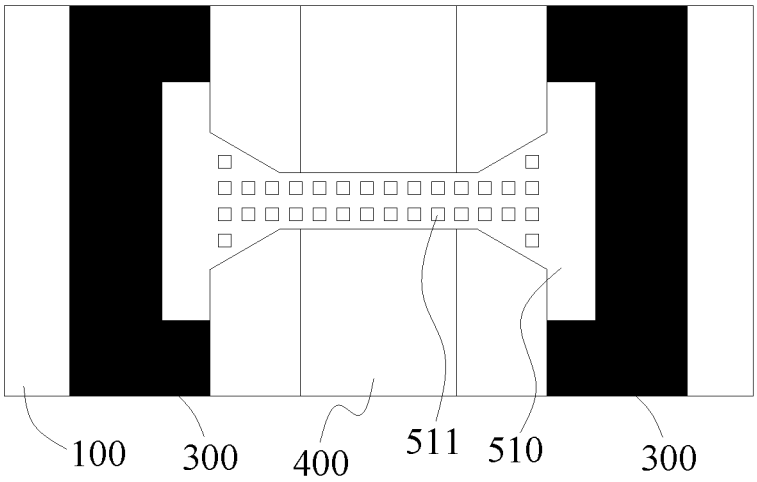
Figure 6:
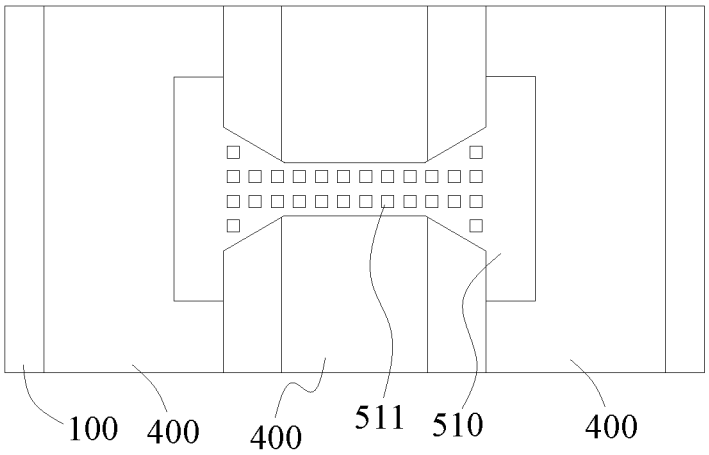
FIG. 6 is a schematic top view of the phase shifter shown in FIG. 5.
Figure 7A:
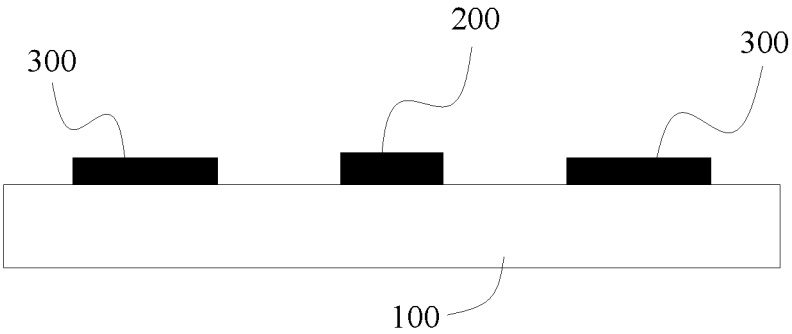
FIGS. 7(*a*) to 7(*e*) are schematic views illustrating a method for manufacturing the phase shifter shown in FIG. 5.
Figure 7B:
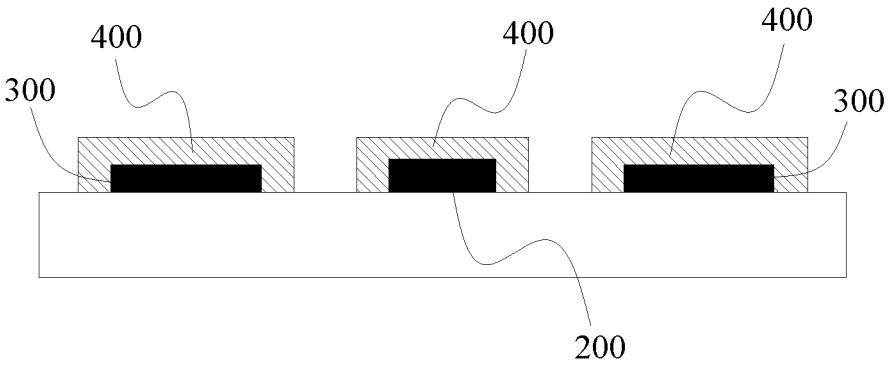
Figure 7C:
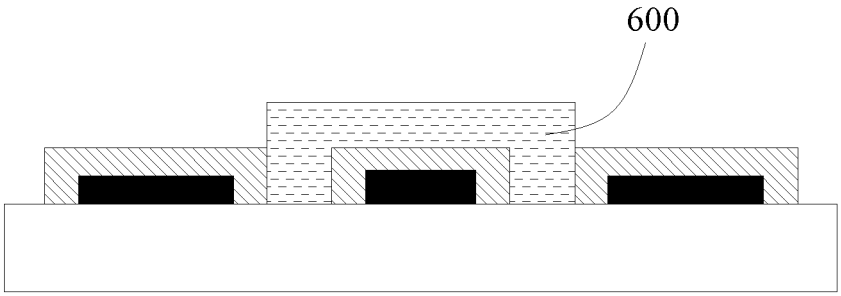
Figure 7D:
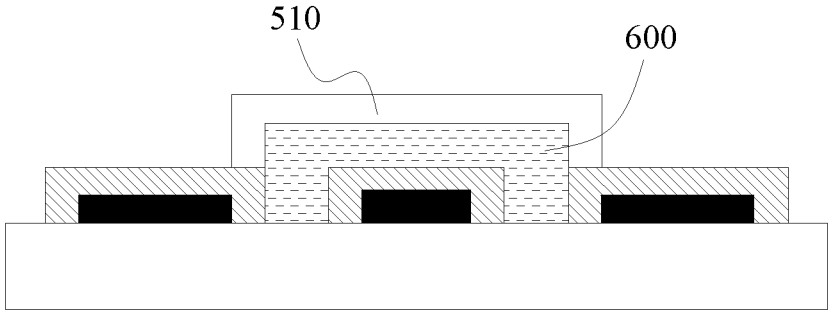
Figure 7E:
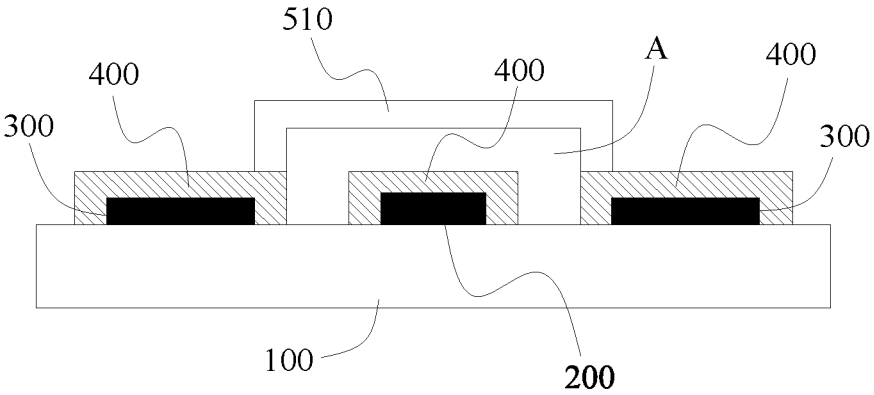
Figure 8A:
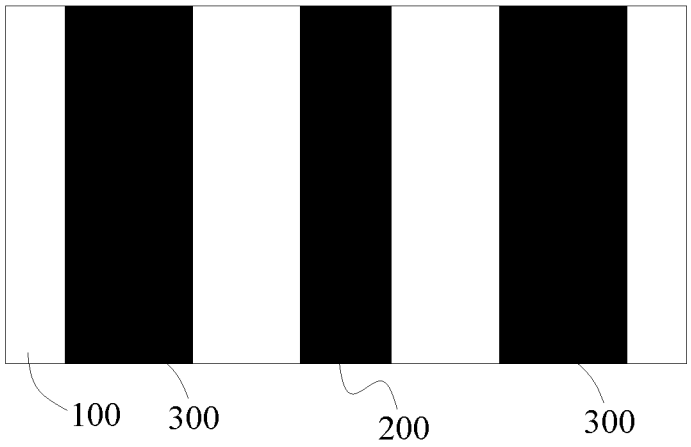
FIGS. 8(*a*) to 8(*e*) are schematic top views corresponding to steps in the manufacturing method shown in FIGS. 7(*a*) to 7(*e*), respectively.
Figure 8B:
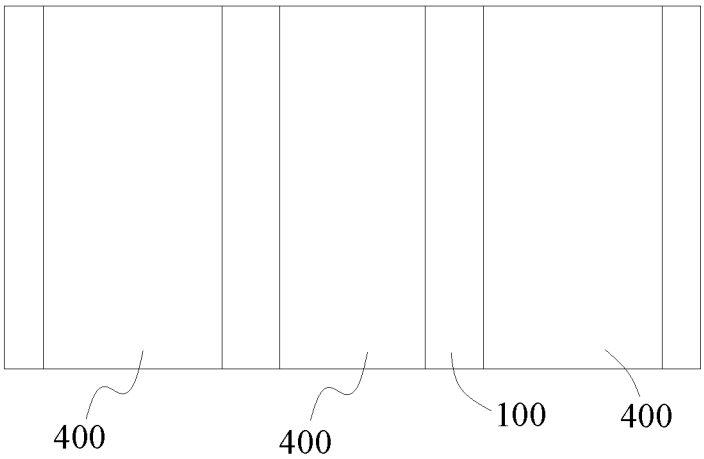
Figure 8C:
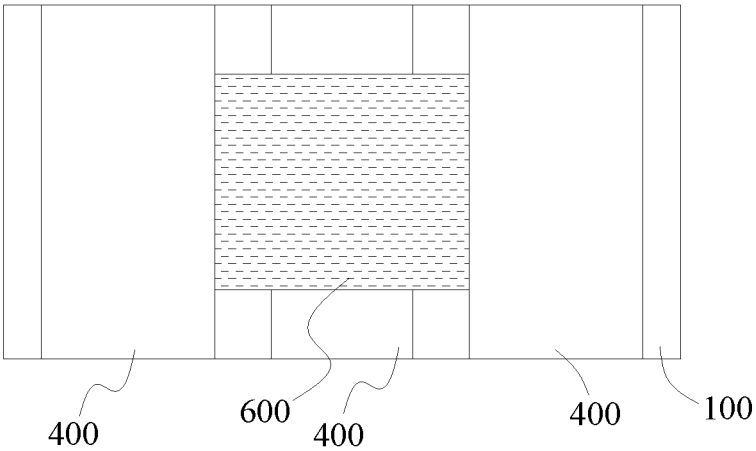
Figure 8D:
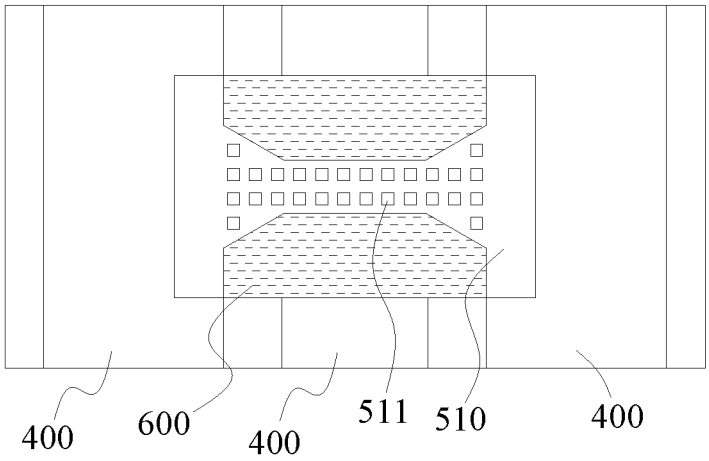
Figure 8E:
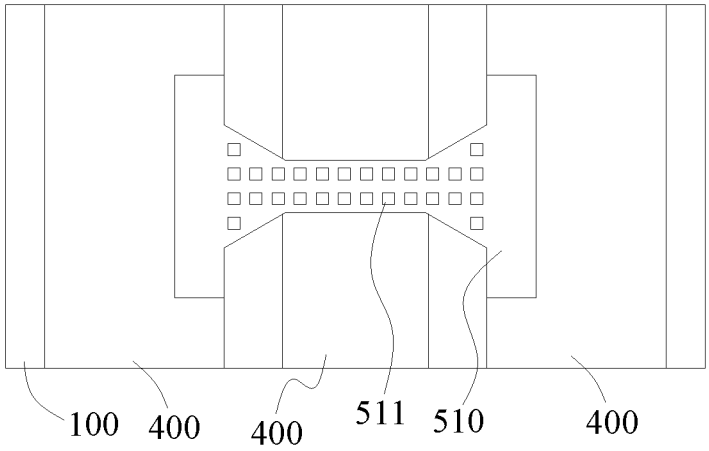
Figure 10:
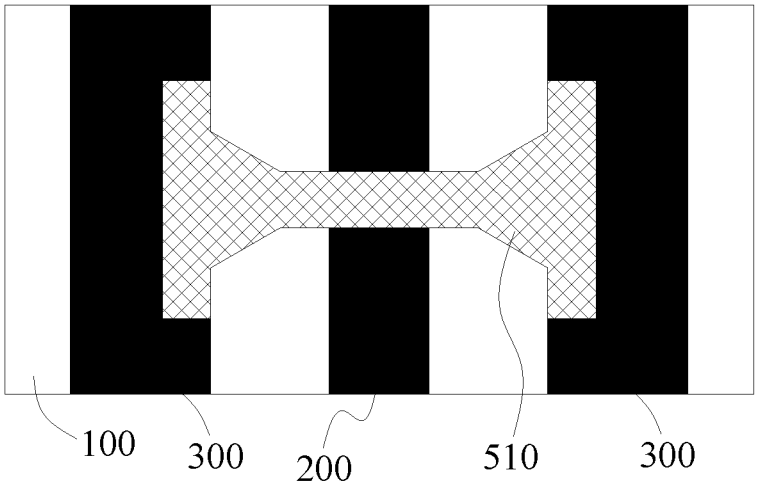
FIG. 10 is a schematic top view of the phase shifter shown in FIG. 9.
Figure 11A:
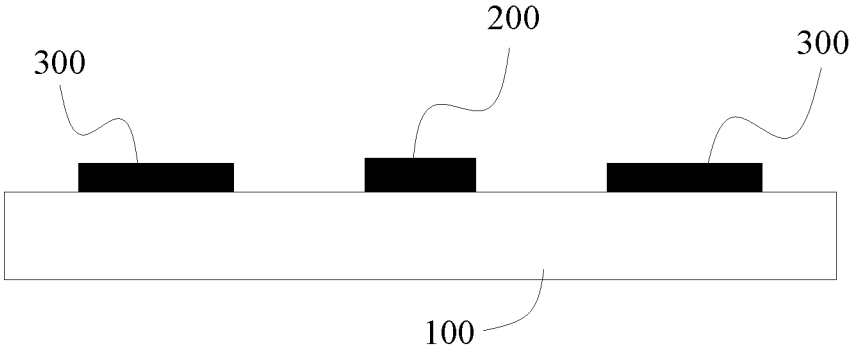
FIGS. 11(*a*) to 11(*e*) are schematic views illustrating a method for manufacturing the phase shifter shown in FIG. 9.
Figure 11B:
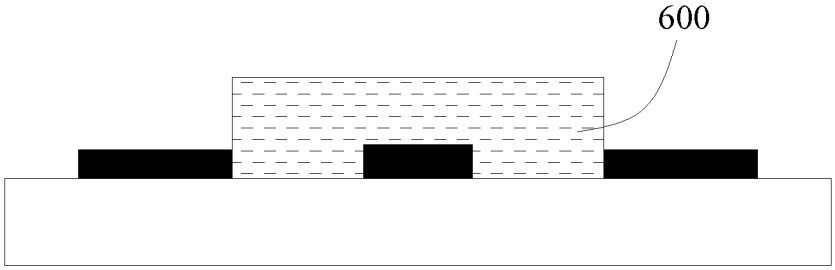
Figure 11C:
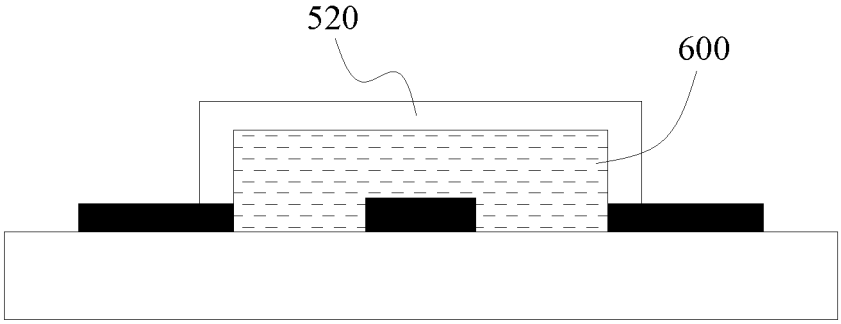
Figure 11D:
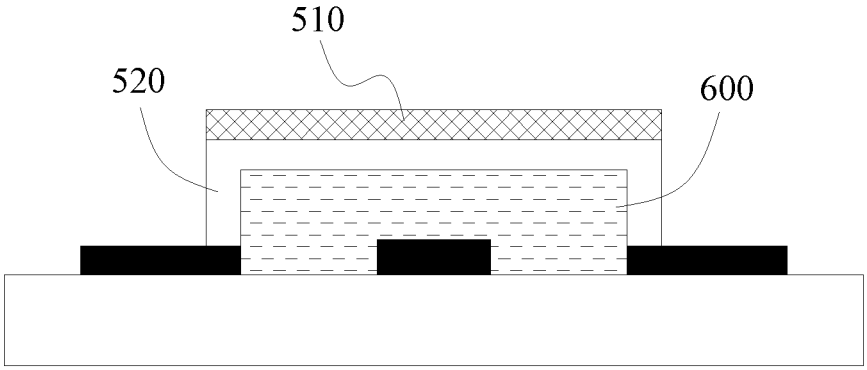
Figure 11E:
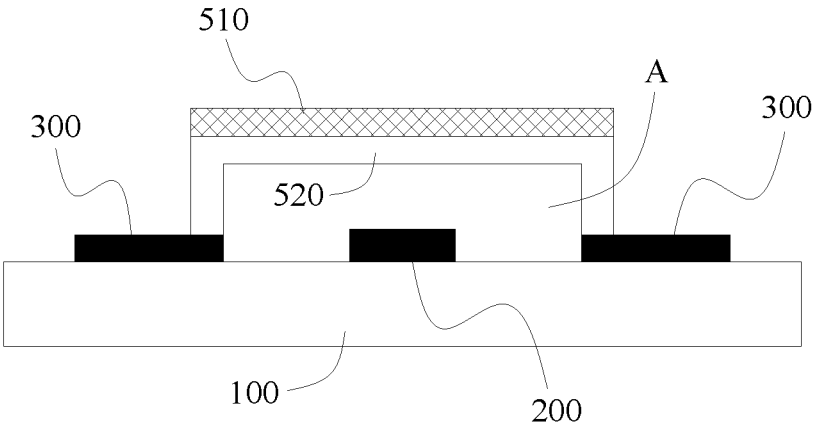
Figure 12A:
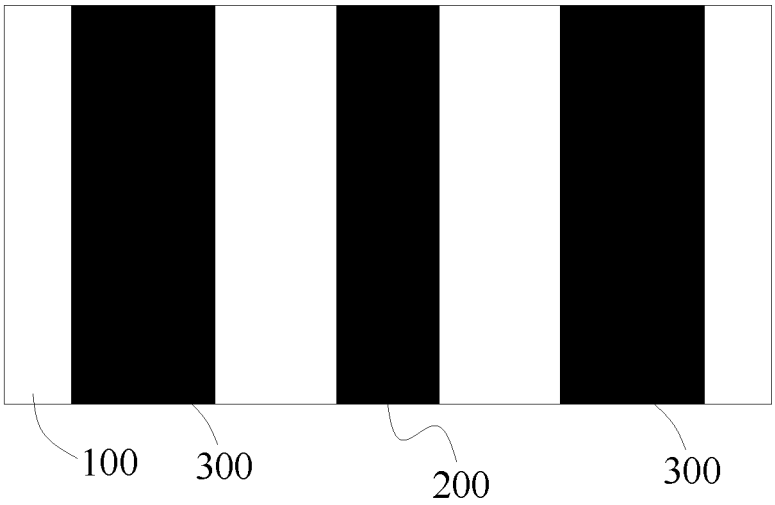
FIGS. 12(*a*) to 12(*e*) are schematic top views corresponding to steps in the manufacturing method shown in FIGS. 11(*a*) to 11(*e*), respectively.
Figure 12B:
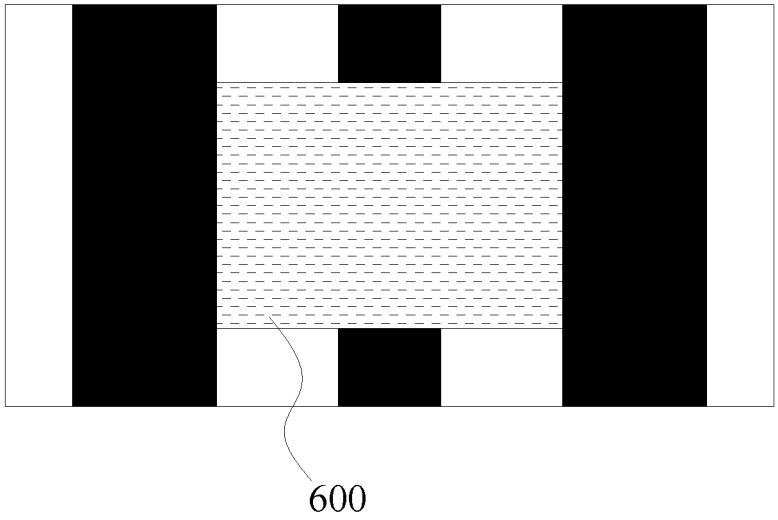
Figure 12C:
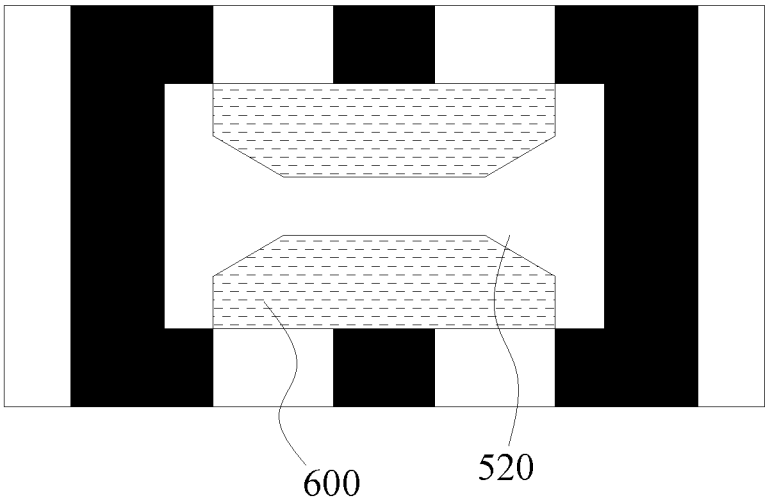
Figure 12D:
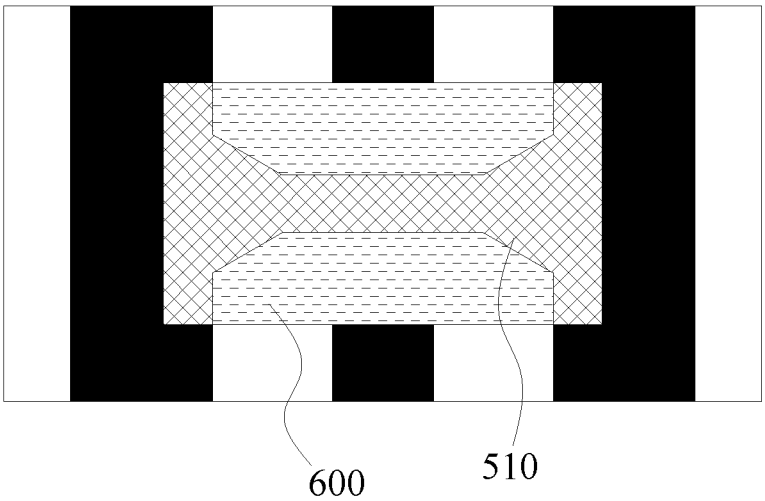
Figure 12E:
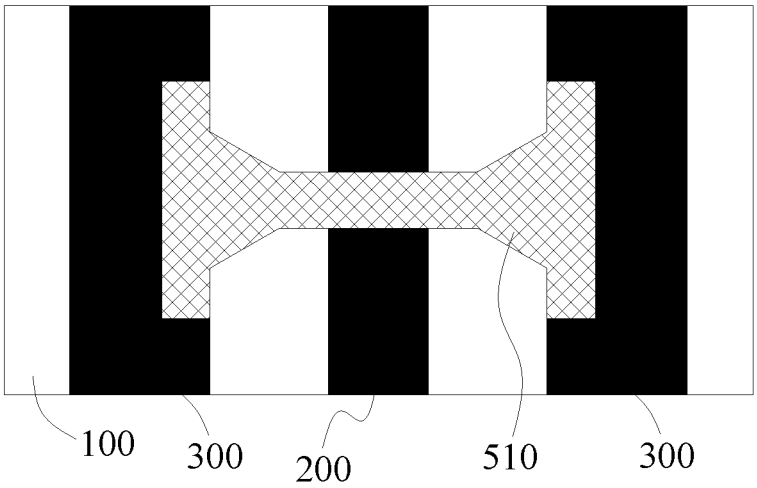
Figure 13A:
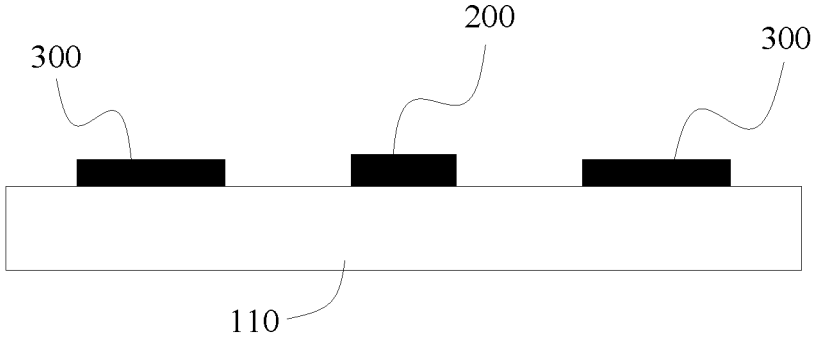
FIGS. 13(*a*) to 13(*e*) are schematic views illustrating another method for manufacturing the phase shifter shown in FIG. 9.
Figure 13B:
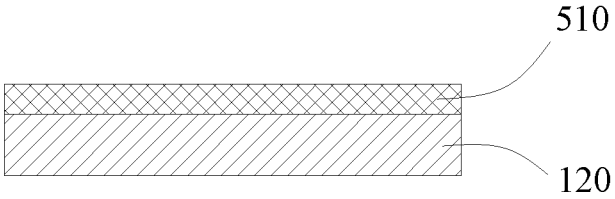
Figure 13C:
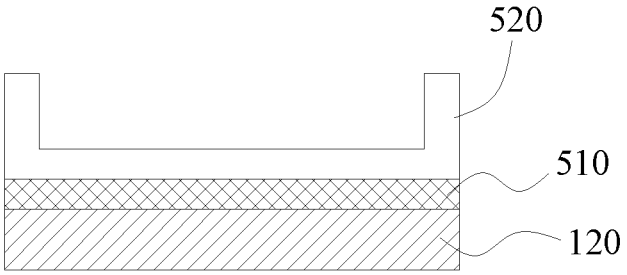
Figure 13D:
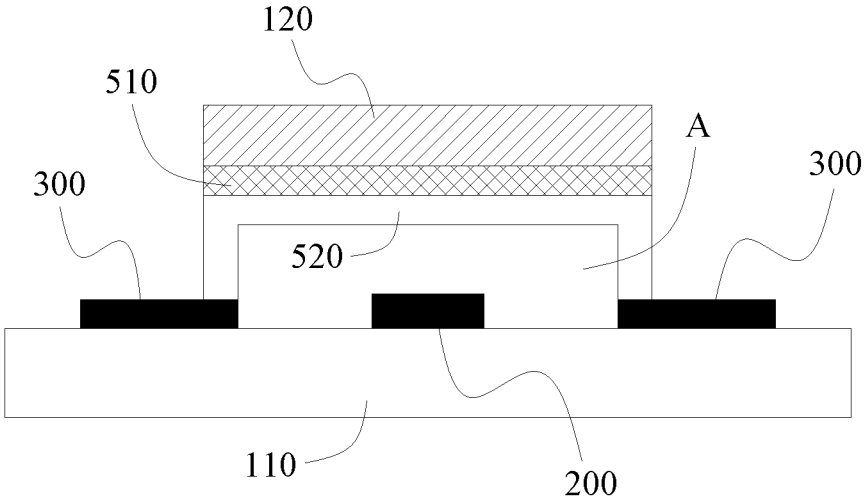
Figure 13E:
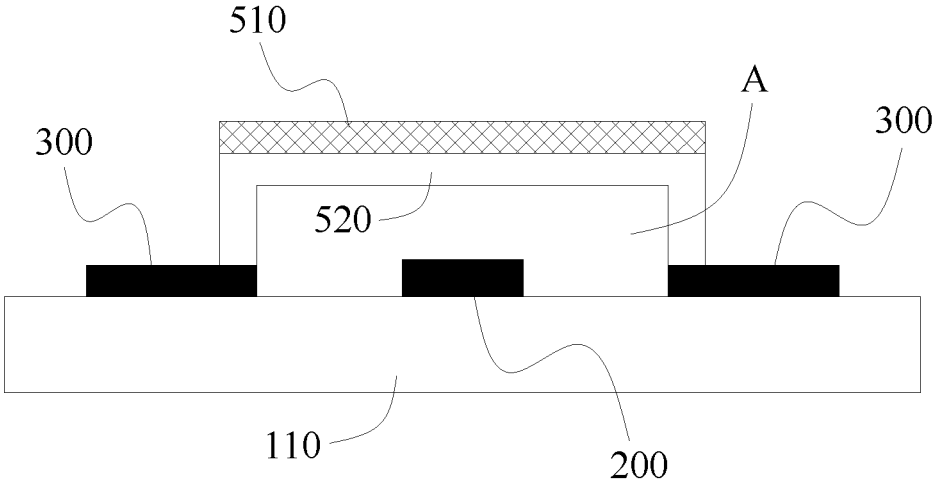

Further, to ensure the accuracy of a relative positional relationship between the metal layer 510 and the signal line 200, as exemplarily shown in FIGS. 2, 6 and 10, the dimension (e.g., the width) of each of both ends of the metal layer 510 in the direction perpendicular to the thickness direction is gradually increased from the central portion of the metal layer 510 to the corresponding connection wall.

In an embodiment of the present disclosure, both ends of the metal layer 510, which are respectively connected to the connection walls, are widened, such that in addition to the residual stress in the film bridge being reduced by the openings 511, the metal layer 510 is effectively prevented from being tilted (i.e., a bridge floor of the metal layer 510 is effectively prevented from turning over), and the parallelism between the metal layer 510 and the signal line 200 is ensured, thereby ensuring the response capability of the metal layer 510 and the signal line 200 in mutual adsorption under the action of a bias voltage.

In order to simplify a structure and a manufacturing process of the film bridge and improve a manufacturing efficiency of the phase shifter, as a first exemplary embodiment of the present disclosure, the film bridge may be made of only a metal material. Specifically, as shown in FIGS. 1, 2, 5 and 6, the film bridge includes only the metal layer 510, and the two connection walls of the metal layer 510 and the remaining portion of the metal layer 510 (i.e., the horizontal portion of the metal layer 510 as shown in FIGS. 1 and 5) have a one-piece structure and include a same metal material.

In the embodiment of the present disclosure, the two connection walls of the metal layer 510 are integrally formed with the remaining portion (which may be referred to as the "bridge floor") of the metal layer 510, and the plurality of openings 511 are arranged in an array on the bridge floor formed by the metal layer 510. As such, the residual stress in the film bridge is released and thus the response capability of the metal film bridge is improved, while the manufacturing process of the film bridge is simplified.

A shape of each of the openings 511 is not particularly limited in an embodiment of the present disclosure. For example, for convenience of arrangement, as exemplarily shown in FIGS. 2 and 6, each of the plurality of openings 511 may be a square, and the square openings 511 are arranged in rows and columns on the bridge floor formed by the metal layer 510.

To improve the safety of a switch formed by the metal layer 510 and the signal line 200, the phase shifter may further include an insulating isolation layer 400 covering the signal line 200 and spaced apart from the metal layer 510, as exemplarily shown in FIGS. 1 and 5. As such, the metal layer 510 is insulated from the signal line 200 by the insulating isolation layer 400, thereby avoiding electric leakage due to the bridge floor formed by the metal layer 510 being in contact with the signal line 200 when the bridge floor formed by the metal layer 510 is pulled down. In this way, the safety of the switch formed by the metal layer 510 (i.e., the film bridge) and the signal line 200 is improved.

As an implementation of the first exemplary embodiment according to the present disclosure, as shown in FIGS. 1 and 2, two connection walls of the metal layer 510 are directly electrically connected to (or are in direct contact with) the two adjacent ground lines 300, respectively.

In the present embodiment, the metal layer 510 is connected to the two ground lines 300 and grounded. When the switch is driven to change its state, a bias voltage needs to be applied to the signal line 200, such that the grounded metal layer 510 and the signal line 200 are adsorbed by each other, and the bridge floor of the metal layer 510 is pulled down.

As another implementation of the first exemplary embodiment according to the present disclosure, as shown in FIGS. 5 and 6, the insulating isolation layer 400 further covers the two adjacent ground lines 300 located on the both sides of the signal line 200, and two connection walls of the metal layer 510 are directly disposed on the insulating isolation layer 400 on the two ground lines 300, respectively. In other words, the metal layer 510 may not be grounded.

In the present embodiment, the bridge floor formed by the metal layer 510 is disposed only across but is not connected with the two adjacent ground lines 300 located on both sides of the signal line 200. As such, when the switch is driven to change its state, a bias voltage may be applied to the metal layer 510, such that the metal layer 510 to which the bias voltage is applied and the signal line 200 are adsorbed by each other, thereby pulling down the bridge floor of the metal layer 510. In the present embodiment, when a plurality of film bridges are disposed above the signal line 200, the number of pulled-down switches may be changed by applying a bias voltage to different numbers of film bridges, thereby adjusting a variation value of a phase of a radio frequency signal transmitted by the signal line 200.

In order to simplify the structure and the manufacturing process of the film bridge and further reduce the bias voltage required for the switch, as a second exemplary embodiment of the present disclosure as shown in FIGS. 9 and 10, the film bridge further includes the flexible strip 520 in addition to the metal layer 510, and both ends (i.e., the two connection walls as described above) of the flexible strip 520 are disposed on the two adjacent ground lines 300, respectively. The flexible strip 520 and the substrate 100 form the space A in which the signal line 200 is located, and the metal layer 510 is disposed on an outer surface of the flexible strip 520 (i.e., a surface of the flexible strip 520 distal to the signal line 200).

In the present embodiment, a bridge body is formed by the flexible strip 520, and the metal layer 510 for forming a switch with the signal line 200 is formed on the bridge floor formed by the flexible strip 520. That is, the conventional metal film bridge is replaced by the flexible strip 520 for realizing the deformation function of the switch, such that the Young's modulus of the film bridge can be further reduced, and the driving voltage required for switching the switch can be further reduced, thereby improving the response capability of the switch formed by the film bridge and the signal line 200.

A material of the flexible strip 520 is not particularly limited in an embodiment of the present disclosure. For example, the material of the flexible strip may exemplarily include a flexible material such as an organic insulating material, and thus the flexible strip can serve as an insulating isolation layer to isolate the signal line 200 and the metal layer 510 from each other. As such, steps of growing and patterning the insulating isolation layer can be reduced or omitted, thereby reducing the manufacturing cost. Further, the film bridge made of the flexible material can have reduced Young's modulus, thereby reducing the driving voltage required for pulling the film bridge down.

It should be noted that in the second exemplary embodiment according to the present disclosure, the elastic force generated when the film bridge is subjected to the switching deformation is mainly provided by the flexible strip 520, and the metal layer 510 only needs to include a small amount of material defining the plurality of openings, such that a thickness of the metal layer 510 and an area occupied by a metal material can be greatly reduced. For example, as exemplarily shown in FIGS. 9 and 10, the metal layer 510 is formed to have a grid shape.

In the present embodiment, the metal layer 510 exemplarily includes a grid pattern region corresponding to the bridge floor of each flexible strip 520 (each mesh (i.e., each hole) of the grid pattern is one opening of the metal layer 510). That is, a metal grid is formed only on the bridge floor formed by each flexible strip 520, an electrostatic adsorption force is generated by the metal grid to realize a function of the switch, and the metal grid only serves as the function of conducting electricity. Compared with the metal layer in the first exemplary embodiment, there is almost no residual stress on the metal grid according to the present embodiment, thereby further reducing the Young's modulus of the film bridge and the driving voltage required for switching the switch, and improving the response capability of the phase shifter.

Figure 14:
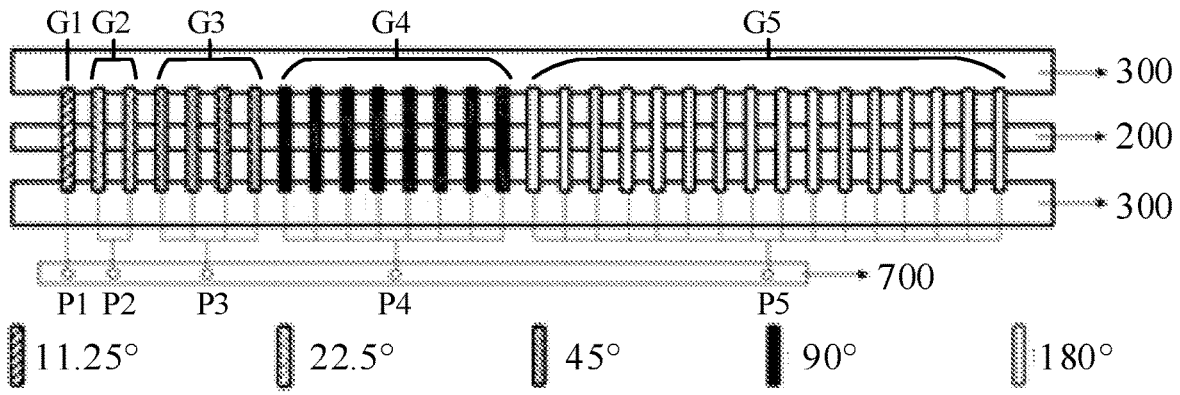
FIG. 14 is a schematic diagram showing a structure of a phase shifter according to an embodiment of the present disclosure.

In order to improve adaptability of the phase shifter and widen application fields of the phase shifter, the phase shifter includes a plurality of groups of film bridges (i.e., a plurality of film bridge groups), as shown in FIGS. 14 to 17. Each group of film bridges includes at least one of the film bridges, and all of the film bridges in a same group of film bridges are electrically connected to each other (e.g., electrically connected in parallel to each other). For example, as shown in FIG. 14, the phase shifter includes 5 film bridge groups, which are a first film bridge group G1, a second film bridge group G2, a third film bridge group G3, a fourth film bridge group G4, and a fifth film bridge group G5. The first film bridge group G1 has 1 film bridge (and the 1 film bridge forms 1 MEMS switch with the signal line 200), the second film bridge group G2 has 2 film bridges (and the 2 film bridges form 2 MEMS switches with the signal line 200), the third film bridge group G3 has 4 film bridges (and the 4 film bridges form 4 MEMS switches with the signal line 200), the fourth film bridge group G4 has 8 film bridges (and the 8 film bridges form 8 MEMS switches with the signal line 200), and the fifth film bridge group G5 has 16 film bridges (and the 16 film bridges form 16 MEMS switches with the signal line 200). In other words, the phase shifter includes N film bridge groups, the i-th film bridge group has $2^{(i-1)}$ film bridges, where N is a positive integer greater than or equal to 1, and i is a positive integer greater than or equal to 1 and less than or equal to N. The phase shifter further includes a bias voltage supply circuit 700 for selectively supplying (or providing) a bias voltage to at least one of the plurality of film bridge groups.

An embodiment of the present disclosure does not specifically limit a manner in which the bias voltage supply circuit 700 is connected to each of the plurality of film bridge groups. For example, as shown in FIGS. 14 to 17, the bias voltage supply circuit 700 has a plurality of DC (i.e., direct current) bias voltage output terminals P1, P2, P3, P4 and P5 which may be in one-to-one correspondence with the plurality of film bridge groups G1, G2, G3, G4 and G5. That is, each DC bias voltage output terminal is connected to a corresponding film bridge group, such that at least one film bridge group corresponding to at least one DC bias voltage output terminal is turned on by selectively applying a bias voltage to the at least one DC bias voltage output terminal.

A single phase shifting unit (i.e., the MEMS switch) formed by a single film bridge and the signal line 200 may not achieve a phase shift of 360°, and thus it is necessary to combine a plurality of phase shifting units together to achieve a phase shift range of 0 to 360°. The number of the film bridge groups is not particularly limited in an embodiment of the present application. For example, an N-bit phase shifter may include $2^N-1$ MEMS switches, and in the example of 5-bit phase shifter as shown in FIG. 14, the phase shifter may include 31 MEMS switches in a cascade, which may be divided into 5 groups according to a degree of phase shift achieved by each bit of the phase shifter. As described above, FIG. 14 shows the 5-bit phase shifter, in which the first bit can achieve a phase shift of 11.25° and includes 1 MEMS switch; the second bit can achieve a phase shift of 22.5° and includes 2 MEMS switches; the third bit can achieve a phase shift of 45° and includes 4 MEMS switches; the fourth bit can achieve a phase shift of 90° and includes 8 MEMS switches; and the fifth bit can achieve a phase shift of 180° and includes 16 MEMS switches. All of the MEMS switches formed by each film bridge group are connected in parallel, 5 film bridge groups form 5 groups of MEMS switches (i.e., 5 MEMS switch groups), respectively, and the 5 groups of MEMS switches may be controlled by 5 DC bias voltage output terminals P1 to P5, respectively.

When no bias voltage is output from any one of the DC bias voltage output terminals of the bias voltage supply circuit 700, a phase of a radio frequency signal transmitted by the phase shifter is unchanged. After bias voltages are respectively applied to the DC bias voltage output terminals corresponding to the MEMS switches for realizing the phase shift of 11.25°, the phase shift of 22.5°, the phase shift of 45°, the phase shift of 90° and the phase shift of 180°, heights of the bridge floors of the film bridges in all the MEMS switches in the film bridge group corresponding to each of the DC bias voltage output terminals are changed to change a capacitance distribution of the coplanar waveguide transmission line, thereby shifting the phase of the radio frequency signal transmitted by the phase shifter. The phase shift of 32 states in the range of 0 to 348.75° (with an interval of 11.25° between any adjacent two of the 32 states) can be realized by performing combined switching on the switch groups corresponding to one or more of the 5 bits achieving different phase shift degrees.

As shown in FIG. 14, the coplanar waveguide transmission line (i.e., the signal line 200 and the two ground lines 300 on both sides of the signal line 200) usually adopts a straight line structure, and thus will occupy a large area when the number of the cascaded MEMS switches is large, which is not favorable for miniaturization, light weight and thinning down of an electronic device. Moreover, an aspect ratio (i.e., a ratio of a length to a width) of the phase shifter being too large may cause the electronic device to be easily broken and have poor stability, and at the same time, cause the cost and difficulty for packaging the device to be increased.

Figure 15:
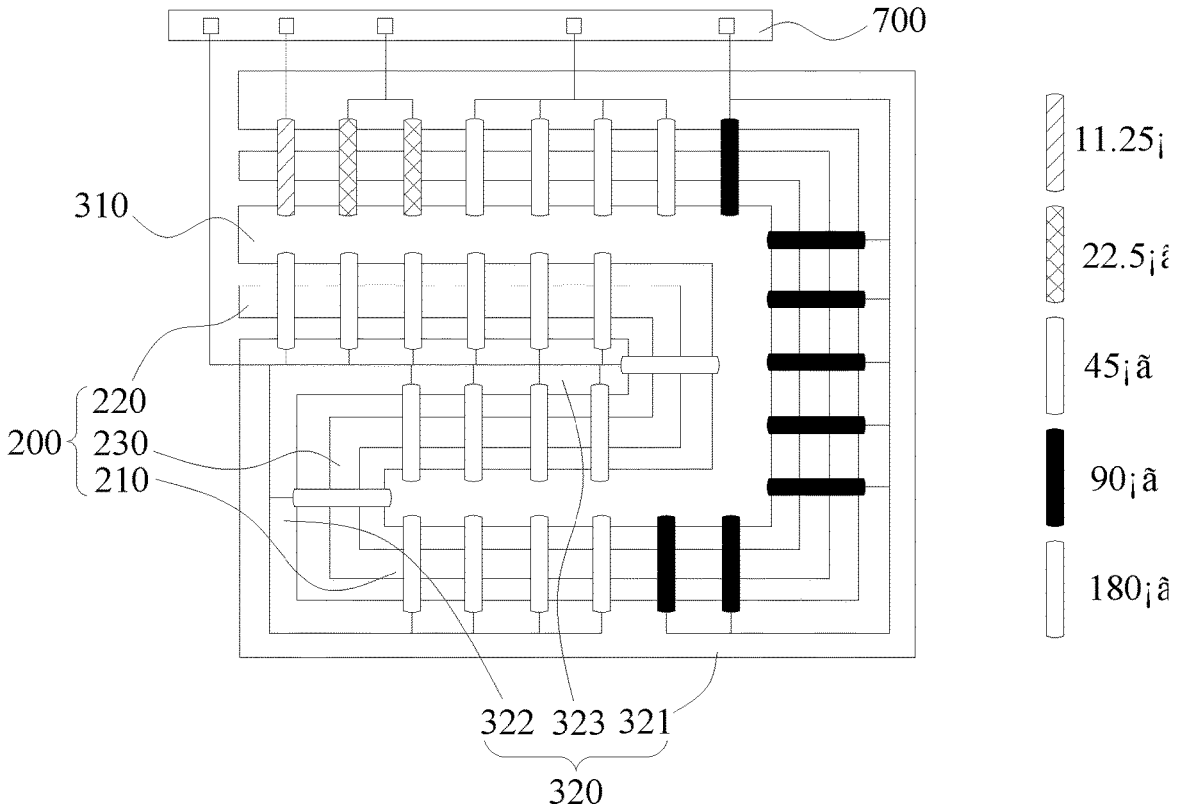
FIG. 15 is a schematic diagram showing a structure of a phase shifter according to another embodiment of the present disclosure.

In order to solve the above technical problems, to achieve miniaturization of the phase shifter and to improve reliability of the phase shifter, as an exemplary embodiment of the present disclosure as shown in FIG. 15, the coplanar waveguide transmission line (i.e., the signal line 200 and two ground lines 300 located on both sides of the signal line 200) adopts a curved line structure. For example, the signal line 200 includes a first U-shaped portion 210, a second U-shaped portion 220, and a first connection portion 230. The second U-shaped portion 220 is disposed inside the first U-shaped portion 210, and an opening of the second U-shaped portion 220 and an opening of the first U-shaped portion 210 are directed to a same direction (e.g., to the left in FIG. 15). The first connection portion 230 electrically connects ends, which are on a same side (e.g., the lower side as shown in FIG. 15), of the first U-shaped portion 210 and the second U-shaped portion 220 to each other. The two ground lines include a first ground line 310 and a second ground line 320. The first ground line 310 is formed to have a U-shape and disposed between the first U-shaped portion 210 and the second U-shaped portion 220. The second ground 320 includes a third U-shaped portion 321, a second connection portion 322, and an extension portion 323. The third U-shaped portion 321 is disposed outside the first U-shaped portion 210, and an opening of the third U-shaped portion 321 and the opening of the first U-shaped portion 210 are directed to a same direction (e.g., to the left in FIG. 15). The extension portion 323 is disposed in the opening of the second U-shaped portion 220, and the second connection portion 322 electrically connects the extension portion 323 to an end of the third U-shaped portion 321 corresponding to (e.g., proximal to) the first connection portion 230.

In the present embodiment, the coplanar waveguide transmission line adopts a folded structure, which not only effectively reduces the length and the area of the phase shifter, improves the reliability of the phase shifter, and reduces the packaging difficulty and the manufacturing cost of the phase shifter, but also significantly improves the utilization rate of the ground lines 300 located on both sides of the signal line 200 by sharing portions of the ground lines, and reduces the manufacturing cost of the phase shifter.

Figure 16:
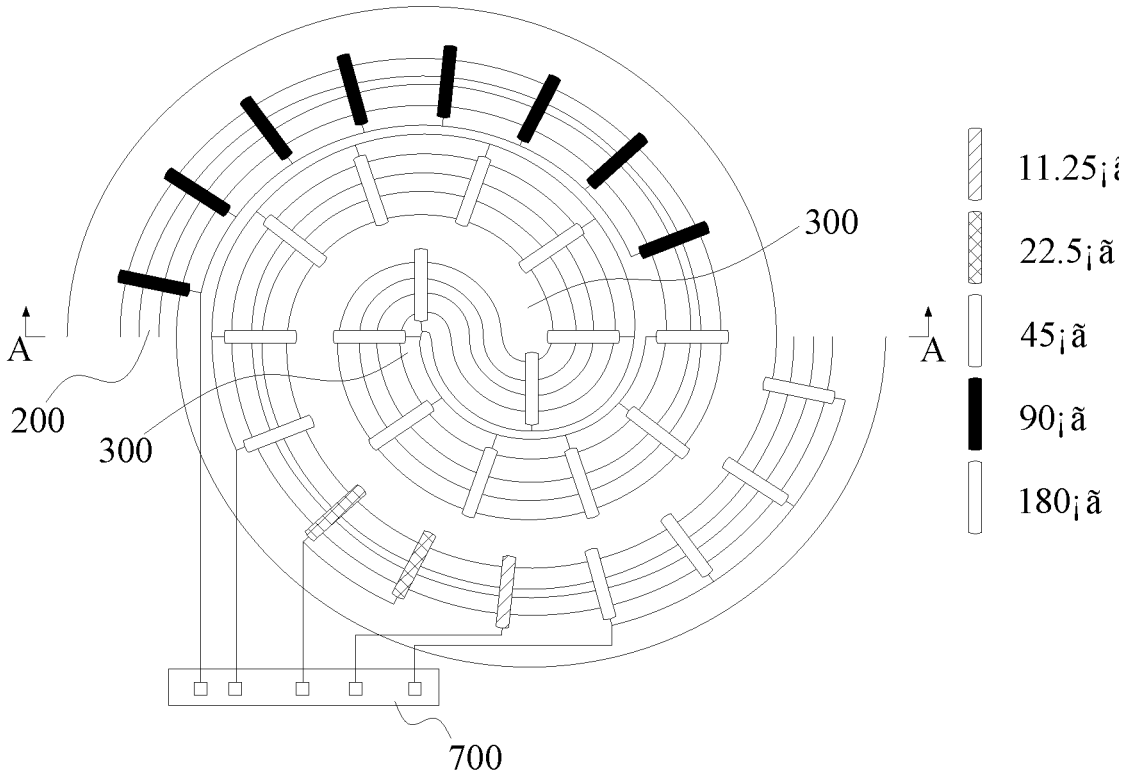
FIG. 16 is a schematic diagram showing a structure of a phase shifter according to another embodiment of the present disclosure.
Figure 17:
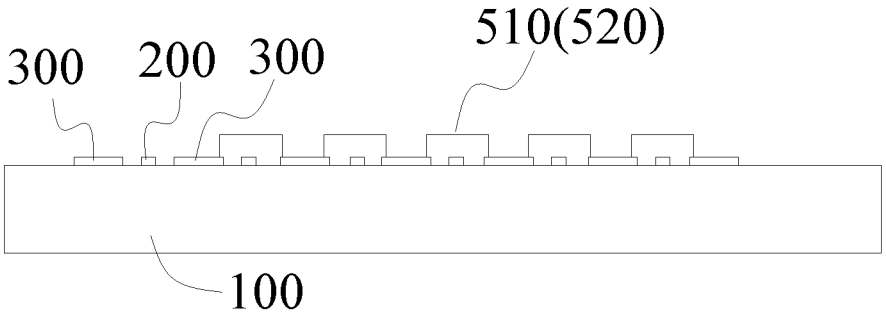
FIG. 17 is a schematic sectional view of the phase shifter shown in FIG. 16 taken along a line A-A.

To further improve a performance of the phase shifter, as another exemplary embodiment of the present disclosure as shown in FIGS. 16 and 17, first ends of the two ground lines 300 (e.g., ends of the two ground lines 300 located at a central portion of a spiral pattern, as shown in FIG. 16) are disposed with an interval therebetween, and second ends of the two ground lines 300 (e.g., ends of the two ground lines 300 located at a peripheral portion of the spiral pattern, as shown in FIG. 16) extend around each other in a same spiral direction. Further, the signal line 200 is bent and provided between the two ground lines 300, and is spaced apart from the two ground lines 300, respectively.

In the present embodiment, the coplanar waveguide transmission line adopts a spiral wiring structure, such that an influence of abrupt change of magnetic field distribution at a corner in a right-angle folded structure on the performance of the phase shifter is avoided, and an impedance matching of the phase shifter is further improved.

It should be understood that, in an embodiment of the present disclosure, the expression of "ground lines in pairs" or "ground lines 300 disposed in pairs" may include at least two ground lines 300. For example, FIG. 1 shows the case of two ground lines 300, and FIG. 17 shows the case of more than two (e.g., 7) ground lines 300. Alternatively, the phase shifter according to an embodiment of the present disclosure may include more than 7 ground lines 300. Further, as shown in FIG. 17, the expression of "ground lines in pairs" or "ground lines 300 disposed in pairs" may mean that, for example, in a direction from the left to the right, the first ground line 300 and the second ground line 300 form one pair, the second ground line 300 and the third ground line 300 form another pair, the third ground line 300 and the fourth ground line 300 form another pair, the fourth ground line 300 and the fifth ground line 300 form another pair, the fifth ground line 300 and the sixth ground line 300 form another pair, and the sixth ground line 300 and the seventh ground line 300 form another pair. One signal line 200 may be disposed between each pair of ground lines 300 (i.e., two adjacent ground lines 300), and at least one film bridge may be disposed on each pair of ground lines 300 (i.e., two adjacent ground lines 300).

As a second aspect of the present disclosure, there is provided a method for manufacturing a phase shifter, as shown in FIGS. 3(*a*) to 3(*e*), FIGS. 4(*a*) to 4(*e*), FIGS. 7(*a*) to 7(*e*), FIGS. 8(*a*) to 8(*e*), FIGS. 11(*a*) to 11(*e*), and FIGS. 12(*a*) to 12(*e*). The method may include the following steps S1 to S3.

In step S1, the substrate 100 is formed. For example, the substrate 100 may be made of glass.

In step S2, the signal line 200 and the two ground lines 300 are formed on the substrate 100, such that the two ground lines 300 are respectively located on both sides of the signal line 200 and spaced apart from the signal line 200, as shown in FIGS. 3(*a*), 4(*a*), 7(*a*), 8(*a*), 11(*a*), and 12 (*a*). For example, each of the signal line 200 and the two ground lines 300 may be made of a metal such as copper, silver, aluminum, gold, or the like.

In step S3, at least one film bridge is formed to be spaced apart from the signal line 200, such that both ends of each film bridge are respectively disposed on the two ground lines 300, the signal line 200 is located in a space A defined by the at least one film bridge and the substrate 100, each film bridge includes the metal layer 510 disposed opposite to the signal line 200, and the plurality of openings 511 penetrating through the metal layer 510 in the thickness direction of the metal layer 510 are formed in the metal layer 510. For example, the metal layer 510 may be made of copper, silver, aluminum, gold, or the like.

Specifically, step S3 may include the following steps S31 and S32.

In step S31, a sacrificial layer 600 is formed on the signal line 200, and the at least one film bridge is formed on the sacrificial layer 600 and the two ground lines 300, such that both ends of each film bridge are respectively located on the two ground lines 300, each film bridge includes the metal layer 510, and the plurality of openings 511 are formed in each metal layer 510, as shown in FIGS. 3(*b*) to 3(*d*), FIGS. 4(*b*) to 4(*d*), FIGS. 7(*b*) to 7(*d*), FIGS. 8(*b*) to 8(*d*), FIGS. 11(*b*) to 11(*d*), and FIGS. 12(*b*) to 12 (*d*). For example, the sacrificial layer 600 may be made of a resin or a photoresist.

In step S32, the sacrificial layer 600 is removed (i.e., the sacrificial layer is released), as shown in FIGS. 3(*d*) to 3(*e*), FIGS. 4(*d*) to 4(*e*), FIGS. 7(*d*) to 7(*e*), FIGS. 8(*d*) to 8(*e*), FIGS. 11(*d*) to 11(*e*), and FIGS. 12(*d*) to 12 (*e*).

In the case where the bridge floor is formed only by the metal layer 510, in order to improve the safety of the switch formed by the metal layer 510 and the signal line 200 and avoid leakage of electricity caused by the bridge floor formed by the metal layer 510 being in contact with the signal line 200 when the bridge floor is pulled down, before step S2, the method may exemplarily further includes: forming the insulating isolation layer 400 at least on the signal line 200, as shown in FIGS. 3(*a*) to 3(*b*), FIGS. 4(*a*) to 4(*b*), FIGS. 7(*a*) to 7(*b*), and FIGS. 8(*a*) to 8(*b*).

For example, in the case where the metal layer 510 needs to be insulated from the ground lines 300, the insulating isolation layer 400 is necessarily formed on both the signal line 200 and the two ground lines 300 (i.e., the case shown in FIGS. 7(*a*) to 7(*b*) and FIGS. 8(*a*) to 8 (*b*)).

In the case where the metal layer 510 is disposed on the flexible strip 520 (e.g., as shown in FIG. 9), the step of forming the at least one film bridge includes the following steps S311 and S312.

In step S311, the flexible strip 520 is formed on the sacrificial layer 600 and the two ground lines 300, such that both ends of the flexible strip 520 are respectively disposed on the two ground lines 300. For example, as described above, the flexible strip 520 may be made of an organic insulating material such as a resin, a plastic, or the like.

In step S312, the metal layer 510 is formed on the flexible strip 520.

Exemplarily, the metal layer 510 has a grid pattern.

As a third aspect of the present disclosure, there is provided another method for manufacturing a phase shifter, which may be used for manufacturing the phase shifter according to the embodiment shown in FIGS. 9 and 10. As shown in FIGS. 13(*a*) to 13(*e*), this method may include the following steps S10 to S60.

In step S10, a first substrate 110 is formed. For example, the first substrate 110 may be made of glass.

In step S20, the signal line 200 and the two ground lines 300 are formed on the first substrate 110, such that the two ground lines 300 are respectively located on both sides of the signal line 200 and spaced apart from the signal line 200, as shown in FIG. 13 (*a*). For example, each of the signal line 200 and the two ground lines 300 may be made of a metal such as copper, silver, aluminum, gold, or the like.

In step S30, a second substrate 120 is formed. For example, the second substrate 120 may be made of glass.

In step S40, the at least one film bridge is formed on the second substrate 120, such that each film bridge includes the metal layer 510, and the plurality of openings 511 penetrating through the metal layer 510 in the thickness direction of the metal layer 510 are formed in the metal layer 510; further, in a direction perpendicular to the thickness direction, a dimension of each of both ends of each film bridge is greater than a dimension of a central portion of the film bridge, as shown in FIGS. 9, 10, and 13(*b*) to 13 (*c*). For example, the metal layer 510 may be made of a metal such as copper, silver, aluminum, gold, or the like.

In step S50, the first substrate and the second substrate are aligned with each other and assembled into a cell, such that both ends of each film bridge are respectively connected to the two ground lines 300 on both sides of the signal line 200, the at least one film bridge is spaced apart from the signal line 200, and the signal line 200 is located in the space A surrounded by the at least one film bridge and the first substrate 110, as shown in FIGS. 13(*c*) to 13 (*d*).

In step S60, the second substrate 120 is removed, as shown in FIGS. 13(*d*) to 13 (*e*).

A manner in which the at least one film bridge is formed in step S40 is not specifically limited in an embodiment of the present disclosure. For example, as an optional embodiment of the present disclosure, the step S40 of forming the at least one film bridge on the second substrate 120 may include the following steps S41 and S41.

In step S41, the metal layer 510 is formed on the second substrate 120, such that the metal layer 510 includes at least one metal grid pattern, as shown in FIG. 13 (*b*).

In step S42, at least one flexible strip 520 is formed on and in one-to-one correspondence with the at least one metal grid pattern, such that each flexible strip 520 of the at least one flexible strip 520 includes two connection walls connected to both ends of the metal layer 510 and the remaining portion (i.e., a central portion) other than the two connection walls, and each of the two connection walls has a thickness greater than a thickness of the central portion, as shown in FIGS. 13(*b*) to 13 (*c*).

The foregoing embodiments of the present disclosure may be combined with and referred to each another in a case of no significant conflict.

It should be understood that the above embodiments are merely exemplary embodiments adopted to explain the principles of the present disclosure, and the present disclosure is not limited thereto. It will be apparent to one of ordinary skill in the art that various changes and modifications may be made therein without departing from the spirit and scope of the present disclosure, and these changes and modifications also fall within the scope of the present disclosure.

What is claimed is:

1. A phase shifter, comprising:

a substrate;

a signal line on the substrate;

ground lines in pairs and on the substrate; and at least one film bridge on the substrate and spaced apart from the signal line, wherein two adjacent ground lines of the ground lines are on both sides of the signal line and spaced apart from the signal line, respectively, both ends of each film bridge are on the two adjacent ground lines, respectively, the signal line is in a space surrounded by each film bridge and the substrate, each film bridge comprises a metal layer opposite to the signal line, the metal layer has a plurality of openings therein, and the plurality of openings penetrate through the metal layer in a thickness direction of the metal layer;

wherein each film bridge further comprises two connection walls on the two adjacent ground lines, respectively, and each connection wall has one end connected to the ground line corresponding to the connection wall, and the other end connected to the metal layer;

wherein the phase shifter further comprise an insulating isolation layer covering both the signal line and the two adjacent ground lines, wherein the metal layer and the two connection walls have a one-piece structure, and the two connection walls are on the insulating isolation layer on the two adjacent ground lines, respectively;

wherein the insulating isolation layer is spaced apart from the metal layer, or wherein the two connection walls are directly on portions of the insulating isolation layer on the two adjacent ground lines, respectively.

2. The phase shifter according to claim 1, wherein each film bridge further comprises a flexible strip, both ends of the flexible strip are on the two adjacent ground lines, respectively, the flexible strip and the substrate form the space, and the metal layer is on an outer surface of the flexible strip.

3. The phase shifter according to claim 2, wherein the metal layer has a grid shape.

4. The phase shifter according to claim 2, wherein the flexible strip comprises an organic insulating material.

5. The phase shifter according to claim 1, further comprising an insulating isolation layer covering the signal line, wherein the metal layer and the two connection walls have a one-piece structure, and the two connection walls are electrically connected to the two adjacent ground lines, respectively.

6. The phase shifter according to claim 5, wherein the insulating isolation layer is spaced apart from the metal layer.

7. The phase shifter according to claim 1, wherein a width of each end of both ends of the metal layer is gradually increased in a direction from a central portion of the metal layer to the connection wall corresponding to the end.

8. The phase shifter according to claim 1, wherein the phase shifter comprises a plurality of film bridge groups, each film bridge group comprises at least one film bridge, and all of film bridges in a same film bridge group are electrically connected to each other; and the phase shifter further comprises a bias voltage supply circuit for selectively supplying a bias voltage to at least one of the plurality of film bridge groups.

9. The phase shifter according to claim 8, wherein the phase shifter comprises N film bridge groups, and an i-th film bridge group has $2^{(i-1)}$ film bridges, where N is a positive integer greater than 1, and i is a positive integer greater than or equal to 1 and less than or equal to N.

10. The phase shifter according to claim 8, wherein all of the film bridges in the same film bridge group are electrically connected in parallel to each other.

11. The phase shifter according to claim 8, wherein the bias voltage supply circuit has a plurality of DC bias voltage output terminals connected in one-to-one correspondence with the plurality of film bridge groups.

12. The phase shifter according to claim 1, wherein a surface of the one end of each connection wall proximal to the signal line is aligned with a surface, which is proximal to the signal line, of the ground line corresponding to the connection wall.

13. A method for manufacturing a phase shifter, the phase shifter being the phase shifter according to claim 1, the method comprising:

forming a substrate;

forming a signal line and two ground lines on the substrate, wherein the two ground lines are disposed on both sides of the signal line and are spaced apart from the signal line, respectively; and forming at least one film bridge spaced apart from the signal line, wherein both ends of each film bridge are arranged on the two ground lines, respectively, the signal line is located in a space surrounded by each film bridge and the substrate, each film bridge comprises a metal layer arranged opposite to the signal line, and a plurality of openings penetrating through the metal layer in a thickness direction of the metal layer are formed in the metal layer.

14. A method for manufacturing a phase shifter, the phase shifter being the phase shifter according to claim 1, the method comprising:

forming a first substrate as the substrate;

forming a signal line and two ground lines on the first substrate, wherein the two ground lines are disposed on both sides of the signal line and are spaced apart from the signal line, respectively;

forming a second substrate;

forming at least one film bridge on the second substrate, wherein each film bridge comprises a metal layer, a plurality of openings penetrating through the metal layer in a thickness direction of the metal layer are formed in the metal layer, and a width of each of both ends of each film bridge is greater than a width of a central portion of the film bridge in a direction perpendicular to the thickness direction;

aligning the first substrate and the second substrate with each other and assembling the first substrate and the second substrate to form a cell, wherein the both ends of each film bridge are connected in one-to-one correspondence with the two ground lines on the both sides of the signal line, the at least one film bridge is spaced apart from the signal line, and the signal line is located in a space surrounded by the at least one film bridge and the first substrate; and removing the second substrate.

15. A phase shifter, comprising: a substrate; a signal line on the substrate, ground lines in pairs and on the substrate; and at least one film bridge on the substrate and spaced apart from the signal line, wherein two adjacent ground lines of the ground lines are on both sides of the signal line and spaced apart from the signal line, respectively, both ends of each film bridge are on the two adjacent ground lines, respectively, the signal line is in a space surrounded by each film bridge and the substrate, each film bridge comprises a metal layer opposite to the signal line, the metal layer has a plurality of openings therein, and the plurality of openings penetrate through the metal layer in a thickness direction of the metal layer;

wherein the phase shifter comprises a plurality of film bridge groups, each film bridge group comprises at least one film bridge, and all of film bridges in a same film bridge group are electrically connected to each other, and the phase shifter further comprises a bias voltage supply circuit for selectively supplying a bias voltage to at least one of the plurality of film bridge groups; and wherein the signal line comprises a first U-shaped portion, a second U-shaped portion, and a first connection portion, the second U-shaped portion is in the first U-shaped portion, an opening of the second U-shaped portion and an opening of the first U-shaped portion are directed to a same direction, and the first connection portion electrically connects ends, which are on a same side, of the first U-shaped portion and the second U-shaped portion to each other;

the two adjacent ground lines comprise a first ground line and a second ground line;

the first ground line has a U-shape and is between the first U-shaped portion and the second U-shaped portion; and the second ground line comprises a third U-shaped portion, a second connection portion, and an extension portion, the third U-shaped portion is outside of the first U-shaped portion, an opening of the third U-shaped portion and the opening of the first U-shaped portion is directed to the same direction, the extension portion is in the opening of the second U-shaped portion, and the second connection portion electricity connects the extension portion to an end of the third U-shaped portion proximal to the first connection portion.

16. The phase shifter according to claim 15, wherein each film bridge further comprises two connection walls on the two adjacent ground lines, respectively, and each connection wall has one end connected to the ground line corresponding to the connection wall, and the other end connected to the metal layer.

17. The phase shifter according to claim 15, wherein a width of each end of both ends of the metal layer is gradually increased in a direction from a central portion of the metal layer to the connection wall corresponding to the end.

18. A phase shifter, comprising: a substrate; a signal line on the substrate, ground lines in pairs and on the substrate; and at least one film bridge on the substrate and spaced apart from the signal line, wherein two adjacent ground lines of the ground lines are on both sides of the signal line and spaced apart from the signal line, respectively, both ends of each film bridge are on the two adjacent ground lines, respectively, the signal line is in a space surrounded by each film bridge and the substrate, each film bridge comprises a metal layer opposite to the signal line, the metal layer has a plurality of openings therein, and the plurality of openings penetrate through the metal layer in a thickness direction of the metal layer;

wherein the phase shifter comprises a plurality of film bridge groups, each film bridge group comprises at least one film bridge, and all of film bridges in a same film bridge group are electrically connected to each other, and the phase shifter further comprises a bias voltage supply circuit for selectively supplying a bias voltage to at least one of the plurality of film bridge groups; and wherein first ends of the two adjacent ground lines are spaced apart from each other, second ends of the two adjacent ground lines extend around each other in a same spiral direction, and the signal line is bent and between the two adjacent ground lines, or wherein the phase shifter comprises N film bridge groups, and an i-th film bridge group has $2^{(i-1)}$ film bridges, where N is a positive integer greater than 1, and i is a positive integer greater than or equal to 1 and less than or equal to N.

19. The phase shifter according to claim 18, wherein each film bridge further comprises two connection walls on the two adjacent ground lines, respectively, and each connection wall has one end connected to the ground line corresponding to the connection wall, and the other end connected to the metal layer.

20. The phase shifter according to claim 18, wherein a width of each end of both ends of the metal layer is gradually increased in a direction from a central portion of the metal layer to the connection wall corresponding to the end.

* * * * *